US006643863B1

(12) United States Patent
Gerber

(10) Patent No.: US 6,643,863 B1
(45) Date of Patent: Nov. 11, 2003

(54) PREFABRICATED SHOWER PAN WITH INTEGRALLY MOLDED CURB REINFORCEMENTS

(76) Inventor: Lloyd Gerber, 6280 NW., 104th Way, Parkland, FL (US) 33076

( * ) Notice: Subject to any disclaimer, the term of this patent is extended or adjusted under 35 U.S.C. 154(b) by 0 days.

(21) Appl. No.: 10/285,346

(22) Filed: Oct. 30, 2002

(51) Int. Cl.[7] ..... A47K 3/022
(52) U.S. Cl. ..... 4/613
(58) Field of Search ..... 4/612, 613, 614, 4/596, 584; 52/34, 35

(56) References Cited

U.S. PATENT DOCUMENTS

| | | | | | |
|---|---|---|---|---|---|
| 2,055,173 | A | | 9/1936 | Deubelbeiss | |
| 2,757,385 | A | | 8/1956 | Whittick | |
| 3,800,335 | A | * | 4/1974 | Buonaura | 4/613 |
| 3,992,825 | A | | 11/1976 | May | |
| 4,557,004 | A | | 12/1985 | Piana | |
| 4,694,513 | A | | 9/1987 | Kiziah | |
| 5,224,224 | A | * | 7/1993 | Hintz et al. | 4/590 |
| 5,299,330 | A | | 4/1994 | Moore et al. | |
| 5,371,980 | A | | 12/1994 | Dix | |
| 5,845,347 | A | * | 12/1998 | Young | 4/613 |
| 5,913,777 | A | | 6/1999 | Gerber | |
| 6,094,757 | A | * | 8/2000 | Torres | 4/613 |

* cited by examiner

*Primary Examiner*—Gene Mancene
*Assistant Examiner*—Huyen Le
(74) *Attorney, Agent, or Firm*—Kevin P. Crosby, Esq.; Brinkley, McNerney, et al.

(57) ABSTRACT

A shower stall pan that includes an integrally molded threshold "curb" with reinforcing ribs to provide sufficient strength for direct installation into the shower structure. The reinforcing ribs are integrally molded into the shower pan structure, which includes the threshold curb. The use of reinforcing ribs under the curb obviates the requirement to use additional framing under the curb portion of the shower pan, and decreases the time, effort and skill required to install the shower pan and thereby decrease the time and effort in constructing a shower stall.

7 Claims, 3 Drawing Sheets

PREFABRICATED SHOWER PAN WITH INTEGRALLY MOLDED CURB REINFORCEMENTS

BACKGROUND OF THE INVENTION

1. Field of the Invention

The present invention relates to prefabricated shower modules, and, particularly, to a pre-molded waterproof shower module bottom element that is reinforced so as to allow installation with a reduced need for additional underlying support material.

2. Description of the Background Art

The construction of a shower stall requires that a waterproof structure be placed along the floor of the shower stall. The waterproof structure is usually a one-piece, continuous surface except for a drain pipe that penetrates the structure through a waterproofjoint. This waterproof structure must cover the entire bottom of the stall floor as well as a vertical portion of the lower wall from the floor up to a suitable height from the floor so as to ensure that water standing in the stall is contained with the structure. The waterproof structure is generally referred to as a shower "pan" and various designs have been used. The conventional practice is to place a single, usually pre-fabricated, unit in the floor of the shower to form the waterproof structure. The shower floor "pan" may be constructed of any waterproof material including metal, polymeric materials or fiberglass. The prefabricated shower floor pans are usually constructed in a light weight, thin and relatively structurally weak manner so as to minimize the cost of the shower floor pan. These lightweight and thin units are therefore susceptible to damage during shipping.

A typical shower stall is usually completely enclosed by solid walls with the exception of a doorway used for ingress and egress. The doorway typically has a "curb" in its lower portion, which is a short wall (usually 4 to 10 inches high) that is used to contain water standing on the floor of the shower. The curb comprises an interior curb wall, which is a short vertical wall portion, that terminates at a horizontal portion that forms the threshold for the shower door. Since the curb is required to hold water standing on the floor of the shower, the interior curb wall, and usually the horizontal portion or threshold, is part of the shower floor pan structure. The curb may also extend along the stall perimeter past the area of the doorway, so as to allow other shower stall wall components to be mounted thereon (e.g. a glass wall portion).

Common shower stall construction usually begins with framing of the walls and floor with wood beams or other building material. The wood or other framing may include structures for soap dishes, must provide a level surface on which to place the shower pan, and the framing must also provide physical support for the curb under the shower stall doorway. Since the curb is at least partially comprised of a portion of the shower floor pan, the framing should provide a solid and tightly fitting support for the curb portion of the pan. Deformation of the shower floor pan, including the curb portion of the pan, that is caused by foot traffic if the supporting frame for the shower floor pan is not in tight contact with the shower floor pan, may result in breakage of the shower floor pan and resultant leaks out of the floor of the shower. The construction of the framing for a shower stall is a time consuming task that requires skill and care, as well as a correspondingly large expense. Errors in the framing may also not be detected until the shower stall is almost completed, at which time repairs are more costly and time consuming. The preparation of the waterproofjoint around the drain pipe is also a critical task that may require repair once the shower stall is finished and require excessive time and effort to repair.

Once a shower stall frame is constructed, a suitable wall material is usually placed over the framing that is above the pan in order to form the shower stall walls. A tile or other suitable surface is then placed over the wall material to form a waterproof surface above the shower floor pan. The similar or different tile or other surface is often also applied over the shower pan to form a finished floor for the shower. The tile or other material forming the finished floor must be formed so as to create an incline with the drain opening at the bottom so as to ensure that the water in the floor of the shower will drain.

SUMMARY OF THE INVENTION

It is an objective of the present invention to provide a pre-formed shower floor pan which provides sufficient structural rigidity so as to allow installation with a minimum of framing construction and other labor.

It is another object of the present invention to provide a low cost shower floor pan which can be easily installed in a shower stall.

It is a further object of the present invention to provide a shower floor pan that is strengthened in an area of more complex shape so as to reduce the likelihood of breakage of that area during transit and use.

The present invention achieves these and further objectives by providing a molded, one piece shower floor pan which has a preformed curb containing reinforcing ribs to provide required strength and structure for the shower pan curb. The shower pan of the present invention also utilizes an integrally molded shower drain.

Other objects, features and advantages of my invention will become more readily apparent upon reference to the following description when taken in conjunction with the accompanying drawings.

DESCRIPTION OF THE PREFERRED EMBODIMENTS

The description of the preferred embodiments of the present invention will be aided by reference to the figures, wherein the same or similar components are identified by the same numeral. The present invention is intended for use in shower stalls which may have a variety of configurations and footprints. FIGS. 1 through 4 illustrate a shower stall with a square footprint, but the present invention may be utilized in shower stalls with any shaped footprint.

Figure 1:
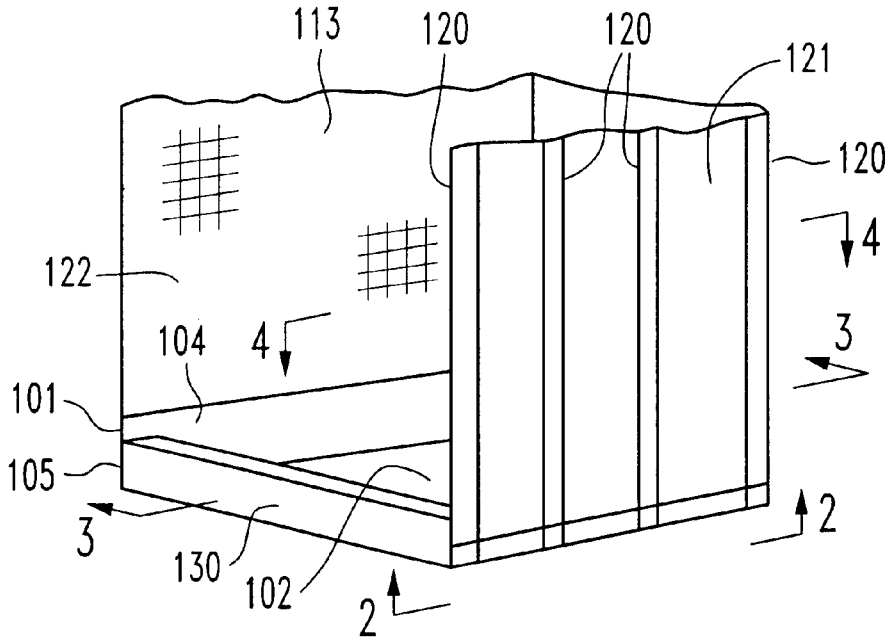
FIG. 1 is a perspective view of a shower stall utilizing the present invention with the rear side of the nearest wall exposed.

FIG. 1 shows the outside of a shower stall wherein the framing of the near wall may be seen. Framing wall studs 120 are generally placed vertically from the floor to the ceiling joints at evenly spaced intervals. The wall, which is framed by the wall studs 120, generally encloses part of the shower stall. The shower stall shown in FIG. 1 has a wall enclosing three of the four sides with one side of the stall forming the stall opening 122. Stall opening 122 may be covered with a shower curtain or glass door as is known in the art.

FIG. 1 shows a shower pan 101 with a shower pan floor 102, a curb 105 and side walls 104. Side walls 104 of the preferred embodiment are integrally molded into the shower pan 101 so as to form a water tight basin for the shower stall. The side walls 104 of the preferred embodiment are constructed so as to be substantially the same thickness as the wall material 121 that is placed over the wall studs 120, or at least be oriented so that the surface thereof facing the drain opening is substantivally coplanar with the adjacent wall surface so that tiles or other wall covering material which will be used to cover the walls and floor of the shower space can be installed against both the interior surface of pan 101 and the adjacent, coplanar, wall surface 113. Using the same thickness for the wall material 121 and the side walls 104 allows tile or other surface 113 to be continuously and seamlessly placed over the wall material 121 and side walls 104. The side walls 104 may be the same height as the curb 105 or may extend higher or lower than the curb 105.

Figure 2:
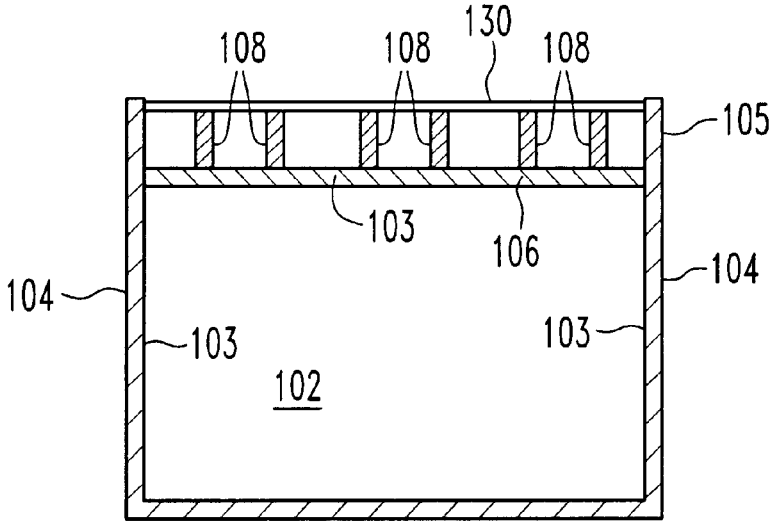
FIG. 2 is a bottom plan view of the underside of a shower pan of the present invention.
Figure 3:
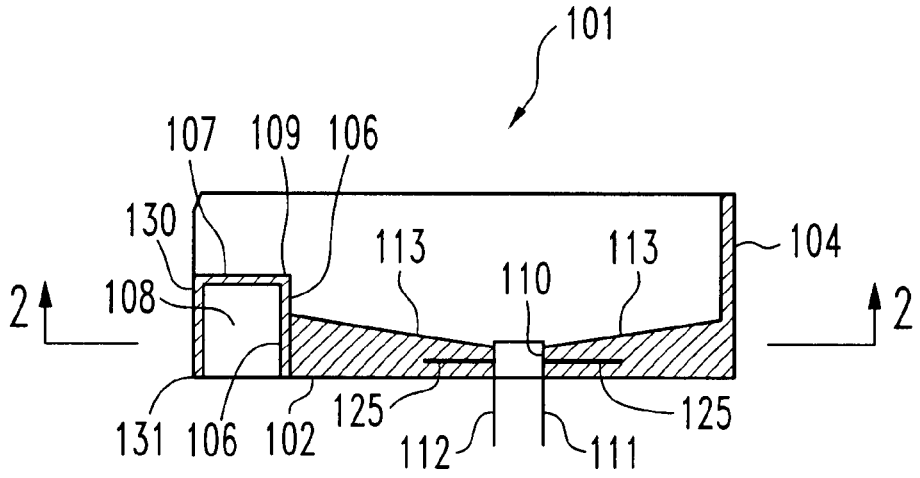
FIG. 3 is a cross-sectional elevational view of a shower pan of the present invention.

FIG. 2 is a bottom cross-sectional view of the shower pan 101 taken along lines 2—2 of FIG. 3. The side walls 104 and shower pan floor 102 are shown. The underside of the curb 105 is shown in detail. The curb 105 of the preferred embodiment comprises three wall portions, the inner vertical curb wall 106, horizontal curb 107 and outer vertical curb wall 130. The underside of the curb is not covered in the preferred embodiment. Reinforcing curb ribs 108 are shown as perpendicular to the three surfaces. The reinforcing curb ribs 108 are integrally molded into the singly molded shower pan 101. The reinforcing curb ribs 108 provide added strength to the curb 105 so as to eliminate the need to construct additional support beneath the curb portion of the shower pan 101 at the construction site during installation of the shower stall. An outer vertical curb wall 130 is not required by the present invention, but a suitable surface to form the front of the curb is generally desired and including the outer vertical curb wall 130 in the integral molding will increase the strength of the curb 105. The side walls 104 are shown as joining the shower pan floor 102 along the shower pan floor edge 103. Side walls 104 are molded along with the shower pan floor 102 so as to form an integrally molded watertight structure.

FIG. 3 illustrates a cross-sectional elevational sectional view of the shower pan 101 showing the tapering floor 102. A tile surface (not shown ) may be installed so as to form an incline with a lowest point at the drain opening 110. FIG. 3 shows a drain pipe 111 entering through the drain opening 110 in shower pan floor 102 through a drain pipe joint 112. In the preferred embodiment, the drain pipe joint 112 is formed by molding the shower pan floor 102 around the drain pipe 111, as is known in the relevant arts. However, other techniques for placing the drain in connection with the pan are contemplated. The drain pipe joint 112 is a water tight connection between the shower pan floor 102 and the drain pipe 111 so that water captured by the shower pan floor 102 will not leak through the drain pipe joint 112. Suitable drain holes may be included along the length of the drain pipe to allow water held by the shower pan floor 102 to drain, as is known in the art. The incline formed for the tile surface 113 may be made by building mortar up as the distance from the drain pipe 11 increases, or the floor 102 of pan 101 itself may be fabricated so as to present an inclined surface as shown in all drawing figures.

FIG. 3 further shows the arrangement of the components of curb 105. The inner vertical curb wall 106 rises from the shower pan floor 102 and joins the horizontal curb wall 107 at the inner vertical curb wall's upper edge 109. The outer vertical curb wall 130 connects at an upper edge thereof to horizontal curb wall 107 and terminates at a lower edge 131 which is substantially coplanar with the planar bottom surface 103 of pan floor 102.

Figure 4:
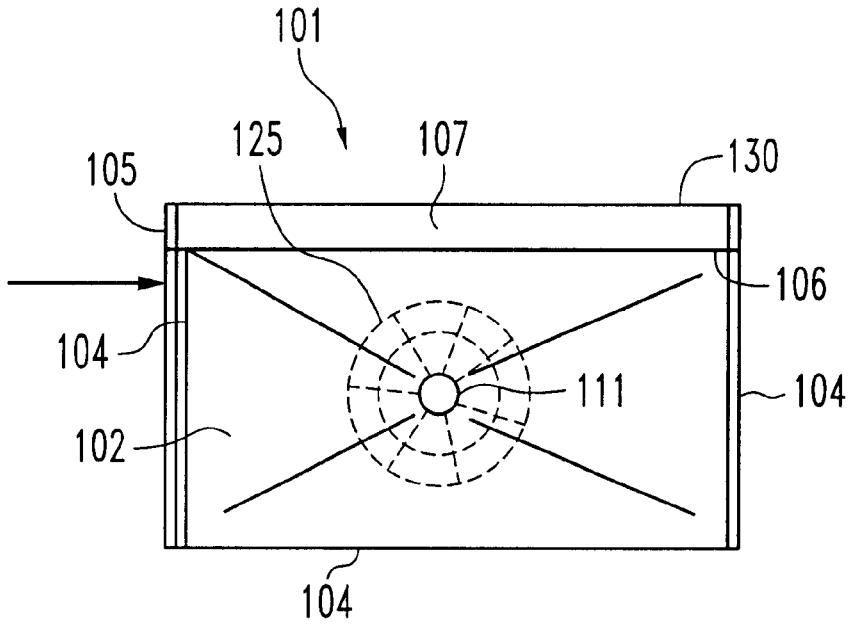
FIG. 4 is a top plan view of a shower pan of the present invention.

FIG. 4 illustrates a top-down view of the shower pan 101. The curb 105 is shown to include an inner vertical curb wall 106, a horizontal curb wall 107 and an outer vertical curb wall 130. Side walls 104 are shown on the other three sides of the shower pan 101. A drain pipe 111 is shown at the middle of the shower floor pan.

The pan 101 of this invention is, preferably, but not by way of limitation, manufactured by a rim molding process using polyurethane. Polyurethane offered by The Bayer Corporation under the designation "645" has been found to be particularly suitable. However, any material which demonstrates suitable strength, hardness, flow and creep characteristics is desirable.

In one embodiment, a drain reinforcement is employed in the form of a wire and fiberglass mesh 125 sandwiched within the floor 102 of pan 101. This mesh is situated in surrounding relationship around drain opening 110, and extends outwardly therefrom and may or may not be bonded to drain element 111. In this way, drain opening 110 is reinforced so that drain element 111 will not tend to break away and/or leak.

It is obvious that the shower pan of the present invention may take on shapes other than the rectangle illustrated above. The shower pan of the present invention may also utilize a curb on more than one side of the pan. The shower pan of the present invention may also be formed with side walls 104 or curbs which are curved or curvilinear.

Figure 5:
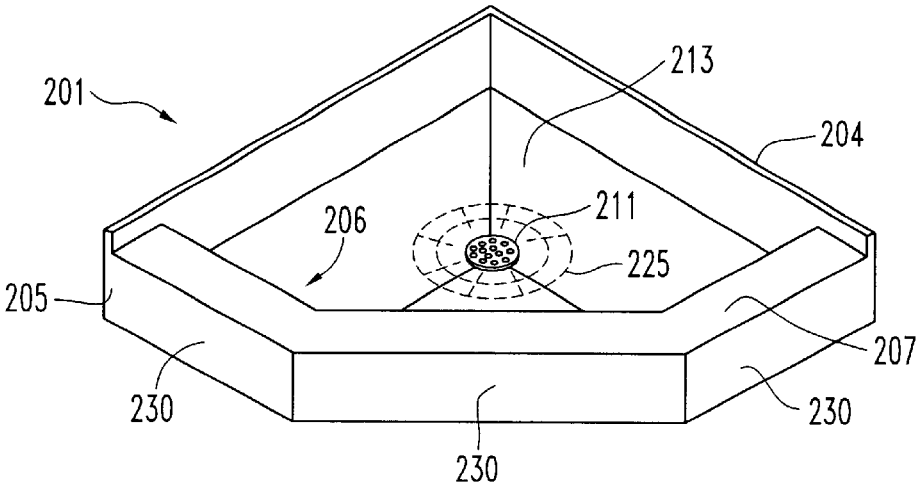
FIG. 5 is a top view of an alternative configuration for a shower pan of the present invention.
Figure 6:
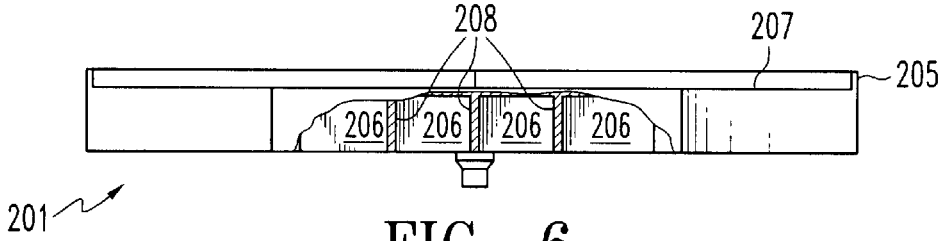
FIG. 6 is a front elevational view of the modified configuration.
Figure 7:
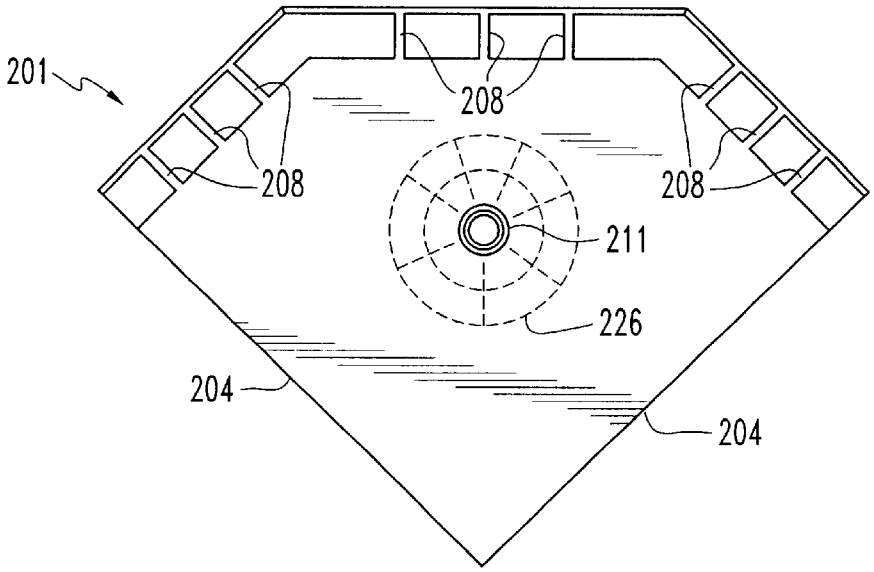
FIG. 7 is a bottom plan view of the embodiment of FIGS. 5 and 6.

An example embodiment of an alternative shower pan shape is shown in FIGS. 5–7. The shower pan 201 shown in FIGS. 5–7 may be installed into a corner of a room, with the two room walls forming the corner mating with side walls 204 of the shower pan 201. The resulting shower stall will have an opening opposite the two room walls formed by the curb 205 may be of any shape, such as curb 205 shown in FIG. 5. This opening may be covered with a shower curtain or a glass wall/door combination as is known in the relevant arts. The shower pan shown in FIGS. 5–7 includes a continuous curb 205 with seamless horizontal curb upper surface 207, inner vertical curb wall 206, outer vertical curb wall 230, and reinforcing ribs 208, to, again, eliminate the need to use reinforcing member(s) below curb 205. It can readily be appreciated that the more the footprint of the pan deviates from a rectangle, the more desirable it is to utilize the instant invention's pre-fabricated curb and reinforced rib structure so as not to require the construction of underlying support(s) for the curb 205. A drain reenforcement mesh 225 may be integrated into the floor 202 of pan 201 to reinforce drain opening 210.

Obviously, numerous modifications and variations of the present invention are possible in light of the above teachings. It is therefore to be understood that, within the scope of the appended claims, the invention may be practiced otherwise than as specifically described herein.

I claim:

1. A pre-formed shower floor pan, comprising:

a floor;

said floor having a plurality of edges;

an inner vertical curb wall which comprises an upper edge and lower edge, wherein said lower edge joins at least one of said plurality of edges;

a horizontal curb wall, wherein said horizontal curb wall is attached to said upper edge; and a plurality of reinforcing curb ribs, wherein each of said reinforcing curb ribs securely engage both said inner vertical curb wall and said horizontal curb wall.

2. A pre-formed shower floor pan according to claim 1, wherein said reinforcing curb ribs are perpendicular to both of said inner vertical curb wall and said horizontal curb wall.

3. A pre-formed shower floor pan according to claim 1, further comprising one or more side walls, each of said one or more side walls joining one of said plurality of edges.

4. A pre-formed shower floor pan according to claim 1, further comprising an outer vertical curb wall, wherein said outer vertical curb wall engages said horizontal curb wall on a side opposite from said inner vertical curb wall.

5. A pre-formed shower floor pan according to claim 4, wherein each of said plurality of reinforcing curb ribs engages said outer vertical curb wall.

6. A pre-formed shower floor pan according to claim 1, wherein said floor further comprises an integrally molded drain pipe.

7. A pre-formed shower floor pan according to claim 6, wherein said floor forms a sloping incline which has a lowest point at said integrally molded drain pipe.

* * * * *